US005197212A

United States Patent [19]

Vail

[11] Patent Number: 5,197,212

[45] Date of Patent: Mar. 30, 1993

[54] AUXILIARY RIPPER TOOTH ATTACHMENT FOR USE IN CONJUNCTION WITH A BACKHOE

[76] Inventor: Donald E. Vail, Rte. #3, Box 222, Enid, Okla. 73703

[21] Appl. No.: 871,056

[22] Filed: Apr. 20, 1992

Related U.S. Application Data

[63] Continuation-in-part of Ser. No. 723,793, Jul. 1, 1991, Pat. No. 5,115,583.

[51] Int. Cl.[5] ..... E02F 3/76; E02F 5/02

[52] U.S. Cl. ..... 37/103; 37/117.5; 37/118 R; 37/141 R; 37/DIG. 3; 37/DIG. 12

[58] Field of Search ..... 37/117.5, DIG. 12, DIG. 3, 37/142 R, 141 T, 118 R, 103, 141 R

[56] References Cited

U.S. PATENT DOCUMENTS

| | | | |
|---|---|---|---|
| 3,596,996 | 8/1971 | Carter | 299/10 |
| 4,041,624 | 8/1977 | Fryrear | 37/117.5 |
| 4,204,348 | 5/1980 | Lydie | 37/117.5 |
| 4,327,509 | 5/1982 | Bean | 37/117.5 |
| 4,531,883 | 7/1985 | Arnold | 414/722 |
| 4,561,199 | 12/1985 | Lockwood | 37/117.5 |
| 4,595,240 | 6/1986 | Pettersson | 299/24 |
| 4,804,309 | 2/1989 | Risch | 37/DIG. 12 |
| 5,115,583 | 5/1992 | Vail . | |

*Primary Examiner*—Dennis L. Taylor
*Assistant Examiner*—J. Russell McBee
*Attorney, Agent, or Firm*—Laney, Dougherty, Hesssin & Beavers

[57] ABSTRACT

An excavation apparatus including a backhoe bucket having a novel ripper tooth assembly secured to a convex rear side of the backhoe bucket. The ripper tooth assembly includes a mounting base attached to the backhoe bucket. A pair of spaced, parallel, tooth-mounting lobes are secured to the opposite side of a base plate from the side thereof facing the backhoe bucket. These lobes are apertured to receive a pivot pin which pivotally supports an elongated ripper tooth. The ripper tooth has a detachable digging point on one end and an impact surface on the other end. The impact surface impacts against an impact pad mounted on the mounting base at a location such that when the tooth digs, the impact surface will bear against the impact pad, and the impact forces will be distributed into the mounting base, and from then, into the backhoe bucket.

5 Claims, 2 Drawing Sheets

AUXILIARY RIPPER TOOTH ATTACHMENT FOR USE IN CONJUNCTION WITH A BACKHOE

RELATED PATENT APPLICATION

This application is a continuation-in-part of my copending U.S. patent application Ser. No. 07/723,793 filed on Jul. 1, 1991, now U.S. Pat. No. 5,115,583, and entitled "Auxiliary Ripper Tooth for Backhoe".

FIELD OF THE INVENTION

This invention relates to an auxiliary ripper tooth attachment which can be attached to a backhoe for the purpose of scarifying or digging the earth with a penetrating tine action in supplementation of the digging action of the backhoe bucket. The auxiliary ripper tooth functions for loosening very hard soil or rock so that it can then be further fragmented and picked up by the backhoe bucket.

BACKGROUND OF THE INVENTION

1. Brief Description of the Prior Art

It has been previously proposed to pivotally secure a ripper tooth to the back side of a backhoe bucket in a position such that the tooth can penetrate into the soil, particularly when the backhoe is tucked or folded upwardly. The ripper tooth carries a sharp pointed cap on its lower digging end, and this enables it to slash deeply into the ground, or even through very hard material in the soil. By reason of the pivotal mounting of the tooth on the backhoe, it can be pivoted about a horizontal axis to an operative position in which the point extends downwardly and slightly forward at a time when the bucket carrying the tooth at its rear side is tucked upwardly in a stored or inactive position by use of a hydraulic cylinder and in a conventional fashion.

In general, the type of ripper tooth which has been mounted on the back of a backhoe carry an aperture through the tooth which permits it to be pivotally pinned between a pair of ears secured to the rear side of the backhoe bucket at a time when it is desired to keep the digger tooth in a inoperative position relative to the backhoe.

A problem which has been encountered in constructions of the type described which have a ripper tooth attached to the back side of the backhoe bucket is that the opposite end of the pivoted ripper tooth from that which carries the pointed cap bangs against the top side of the backhoe bucket repeatedly as the ripper tooth is used. In some cases, the impact transmits large forces to the top of the backhoe bucket as the ripper tooth engages hard rock during the downward travel of the backhoe bucket to which it is mounted. The hard metal of the ripper tooth at this blunt end location can wear into, and damage, the backhoe bucket.

One type of ripper tooth or tine structure which has been used by securement to the back side of a backhoe bucket has carried the blade shank in a fixed, downwardly extending position. Since this causes the ripper tooth to interfere with the backhoe bucket when the bucket is to be used alone, it is possible to attain full and efficient usage of the bucket only by removing the ripper tooth. In some digging situations, the inconvenience and inefficiency is simply tolerated. It is also more difficult to effectively use this fixed position ripper tooth, even when ripping is the only type of digging to be performed.

2. Brief Description of the Present Invention

The present invention relates to a ripper tooth attachment assembly which is constructed specifically t facilitate its attachment by welding or the like to the convex back side of the backhoe bucket so that a ripper tooth forming a part of the assembly can be used in aid of the excavating action normally realizable from the backhoe bucket. The ripper tooth attachment assembly can be quickly and easily secured to the backhoe bucket, and functions effectively in use to impale and dig into hard soils, and loosen these soils for later effective removal by the backhoe in conventional digging action.

Broadly described, the ripper tooth attachment assembly of the invention includes a mounting base subassembly which is adapted to be attached to the convex rear side or bottom of a backhoe bucket. The mounting base subassembly includes a generally rectangular base plate which carries a pair of spaced attaching plates on one side of the base plate. Each of these spaced attaching plates carries a concave free edge which is configured in its curvature to mate with the convex arcuate rear side of the backhoe bucket. Thus, these attaching plates can be easily welded over their entire length to the back side of the backhoe bucket due to their complementary configuration.

The opposite side of the rectangular base plate carries a pair of spaced, parallel tooth-mounting ears or lobes which project rearwardly, and which define a pair of aligned tooth-mounting apertures or openings which are adapted to receive a pivot pin. In a preferred embodiment of the invention, these openings carry bushings. A pivot pin is extended through the apertures in these ears or lobes, and also through a large bearing sleeve carried in an opening centrally located in an elongated ripper tooth.

The lower end of the thus pivotally mounted ripper tooth carries a detachable point. At its opposite or second end, the elongated ripper tooth carries an impact surface which is positioned to beat or hammer against an impact pad built up at the upper edge of the rear side of the rectangular base plate. The impact pad extends over the entire space between the tooth-mounting ears, and thus functions to distribute the impact forces transmitted thereto during the use of the elongated ripper tooth to the entire base plate, and from the base plate through the mounting base subassembly into the expanse of metal included in the construction of the backhoe bucket.

GENERAL DESCRIPTION OF THE DRAWINGS

DETAILED DESCRIPTION OF A PREFERRED EMBODIMENT OF THE INVENTION

Figure 1:
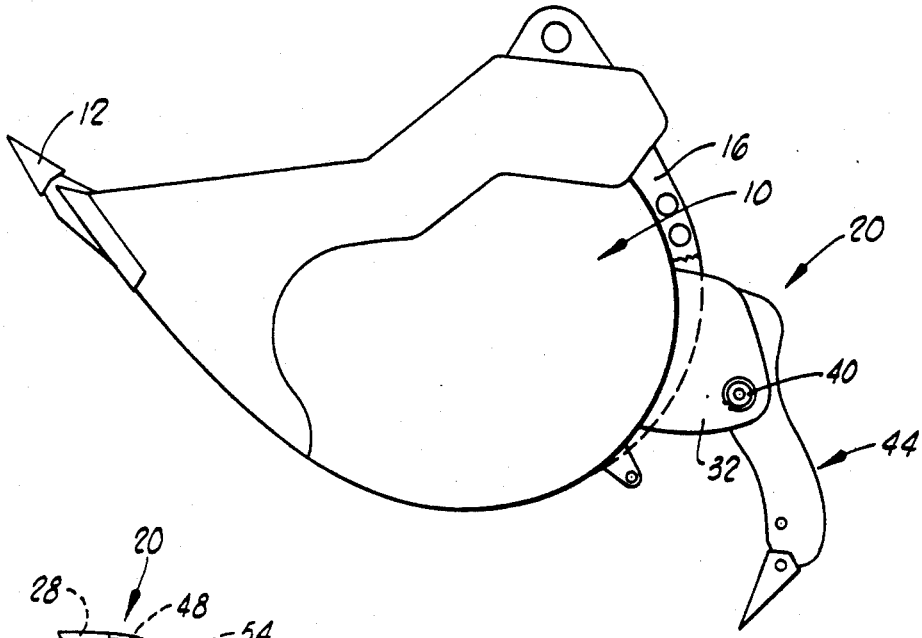
FIG. 1 is a side elevation view of a backhoe bucket having the ripper tooth attachment of the present invention secured thereto, and showing the ripper tooth in operative position.
Figure 2:
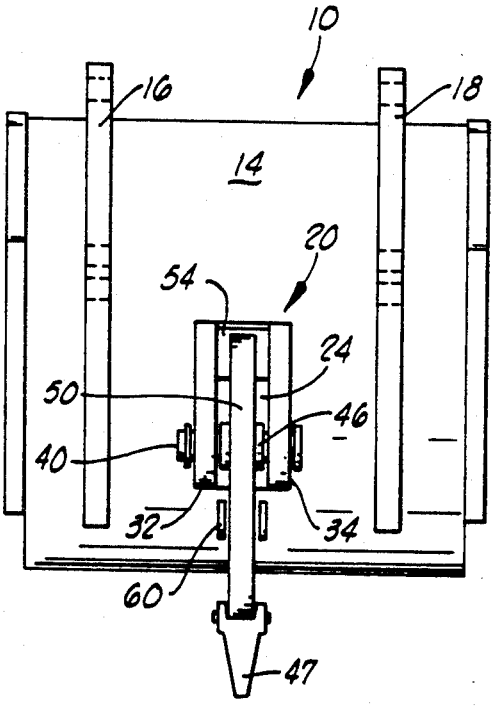
FIG. 2 is a rear elevation view of the assembled backhoe bucket/ripper tooth structure shown in FIG. 1.
Figure 4:
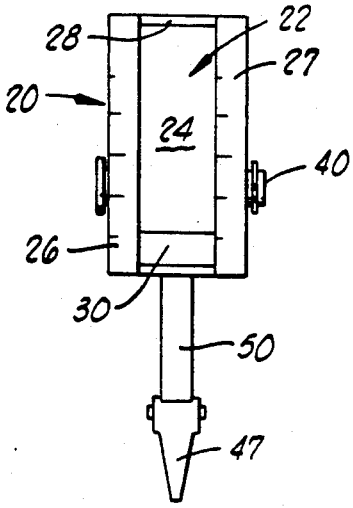
FIG. 4 is a rear elevation view of the ripper tooth attachment.
Figure 5:
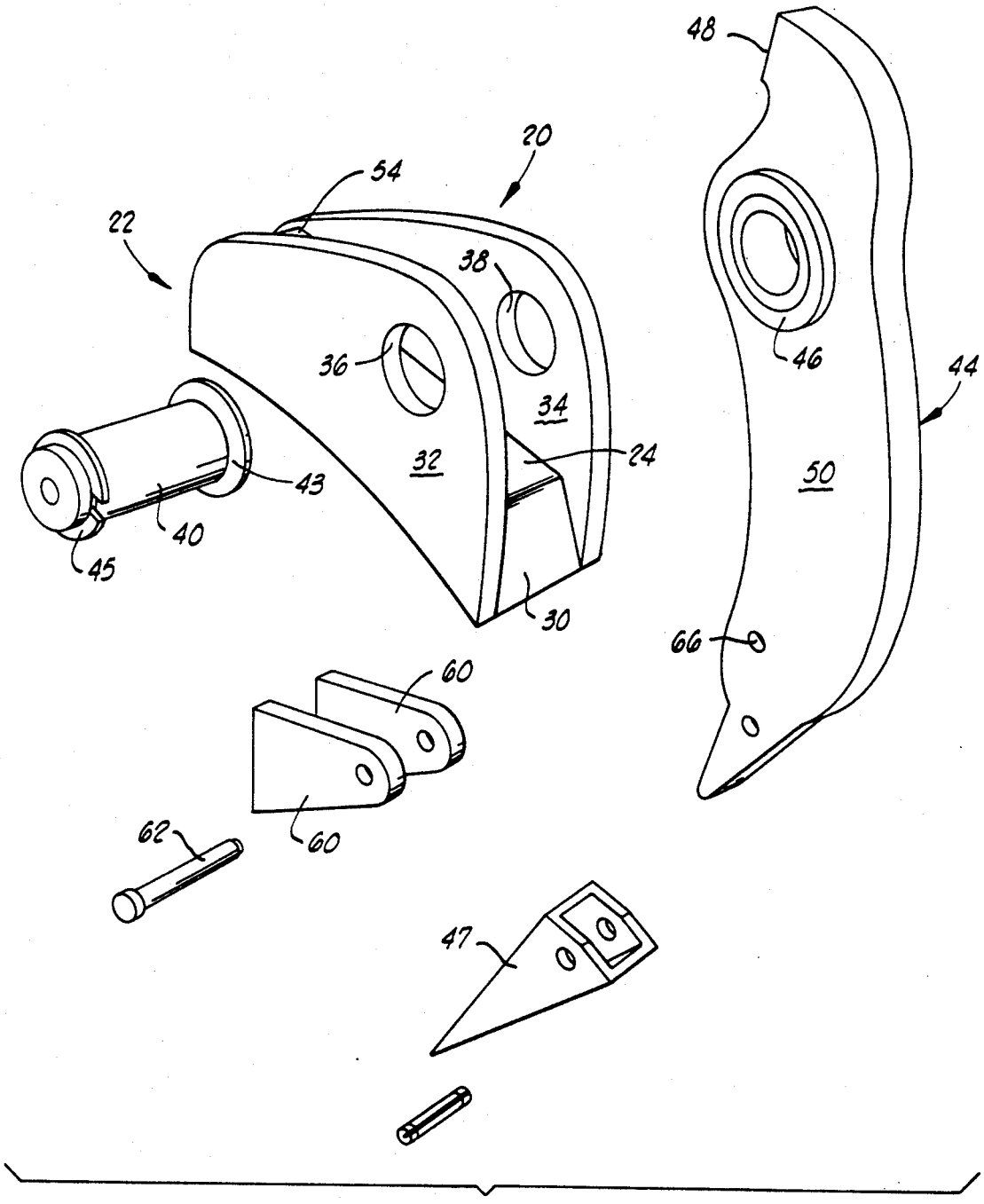
FIG. 5 is an exploded perspective view of the ripper tooth attachment of the invention.

Referring initially to FIGS. 1 and 2 of the drawings, shown therein is a bucket 10 of the type which is typically used in a backhoe apparatus for purpose of excavating the earth. The backhoe bucket 10 carries teeth 12 at the lower forward side thereof and has a generally concave rear wall 14 which forms a bottom of the bucket. A pair of substantially parallel structural reinforcing and attaching ribs 16 and 18 extend downwardly on the outer side of the rear wall 14 of the bucket 10 and are spaced from each other as shown in FIG. 2 of the drawing. Secured to the concave outer surface of the rear wall 14 of the bucket 10 at a location between the ribs 18 and 20 is a ripper tooth assembly 20 constructed in accordance with the present invention.

The ripper tooth assembly 20 includes a mounting base subassembly 22 adapted for attachment to the rear side of the backhoe bucket 10 in the manner shown in FIGS. 1 and 2 of the drawings. The mounting base subassembly 22 includes a generally rectangular base plate 24 which carries a pair of spaced attaching plates 26 and 27 secured to that side of the rectangular base plate which faces toward the concave rear wall 14 of the backhoe bucket 10. The spaced attaching plates 26 and 27 each have a concave free edge which faces toward the backhoe bucket. Each of the free edges conforms in curvature to the convex curvature of the back side 14 of the backhoe bucket 10. The mounting base subassembly further includes a pair of transverse plates 28 and 30 which are also dimensioned to contact the convex back wall of the bucket 10 as shown in FIG. 1. The mounting base subassembly 22 is secured to the convex back wall 14 of the bucket 10 by welding so that it occupies a position between the structural reinforcing and attaching ribs 16 and 18 as shown in FIG. 2.

Figure 3:
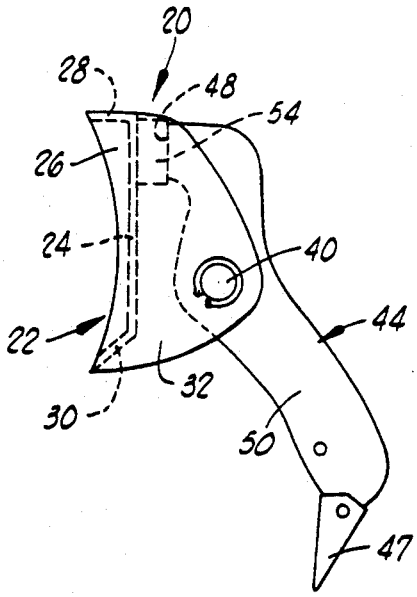
FIG. 3 is a side elevation view of the ripper tooth attachment of the invention.

On the opposite side of the base plate 24 from the side upon which the attaching plates 26 and 27 and transverse plates 28 and 30 are located, the base plate carries spaced, parallel, apertured tooth-mounting lobes or ears 32 and 34. These tooth-mounting lobes or ears 32 and 34 are illustrated in FIGS. 1–3 of the drawings, and extend parallel to each other as well as parallel to the structural reinforcing ribs 16 and 18. The tooth-mounting ears 32 and 34 have pin-receiving apertures 36 and 38 formed therethrough and when the ears 32 and 34 are mounted as shown, these apertures 36 and 38 are aligned for purposes of receiving a pivot pin 40 as shown in the several figures of the drawings. In a preferred embodiment of the invention, a pin bushing is pressed into, and secured in, the aperture 36, and a similar pin bushing is pressed into, and secured in, the aperture 38, and these bushings receive the pivot pin 40. The pivot pin 40 is retained in its operative position by a head or by an annular flange 43 welded therearound at one end, and by a split locking ring or split spring washer 45 mounted in an annular groove around the pivot pin near its other end on the outer side of the tooth-mounting ea 32.

An elongated ripper tooth, designated generally by reference numeral 44, is mounted between the tooth-mounting ears 32 and 34 by means of the pivot pin 40. In a preferred embodiment of the invention, a large bearing sleeve 46 is carried in a pin and bearing opening formed through the ripper tooth and functions to receive the pivot pin 40. The elongated ripper tooth 44 carries a detachable point 47 at one end of the tooth, has an impact surface 48 formed at the other end thereof and has an elongated shank portion 50 extending between the two ends of tooth. The pivot pin 40 is extended through the bushings in the pin-receiving apertures in the tooth-mounting ears 32 and 34, and also through the bearing sleeve 46 mounted in the opening through the shank portion 50 of the ripper tooth 44.

The ripper tooth can thus pivot about the pivot pin 40, and can move, at one extreme of its travel, to the position illustrated in FIG. 3 of the drawings. In this position, the ripper tooth 44 is in its operative digging position, and the impact surface 48 bears against a large impact pad or block 54. The impact pad 54 is secured between the tooth-mounting ears 32 and 34 at a location adjacent the upper edge of the base plate 24. This aligned relationship of the impact surface 48 and impact pad or block 54 assures that the tendency toward wear engendered by the repeated impacting of the impact surface of the tooth 44 as the tooth is used will not wear away the base plate 24 used in the base subassembly 22. As the bucket is moved back and forth in a digging action, the ripper tooth 44 swings freely about the pivot pin and the impact surface 4 impacts repeatedly upon the impact pad or block 54.

The ripper tooth-mounting assembly 20 can be quickly and easily secured to the convex back side of the backhoe bucket 10 by welding along the locations where the attaching plates 26 and transverse plates 28 and 30 contact the convex rearwardly facing surface of the backhoe bucket. With the ripper tooth attachment so located, the weld lines by which it is secured to the back side of the backhoe bucket 10 are protected, to a substantial extent, by the reinforcing ribs 16 and 18, and the impact forces resulting from the use of the ripper tooth are spread over a relatively large area as they are transmitted through, first, the impact pad or block, and then through the mounting base.

When the ripper tooth 44 is not to be used, it can be pinned in a stationary position against the back side of the backhoe bucket. This is accomplished by means of the retainer ears 60 and the retainer pin 62. The retainer pin 62 is at this time extended through a small retainer pin hole 66 extended through the shank of the ripper tooth 44. In this closepinned position of the ripper tooth, it does not interfere with the digging action of the backhoe bucket when the bucket alone is to be used for digging.

Although a preferred embodiment of the invention has been herein described in order to better illustrate the invention and the principles upon which it is based, changes and innovations can be made in the described embodiment of the invention without departure from such basic principles. Changes and innovations of this type are therefore deemed to be circumscribed by the spirit and scope of the invention, except as the same may be necessarily limited by the appended claims or reasonable equivalents thereof.

What is claimed is:

1. A ripper tooth attachment assembly for a backhoe comprising:

a mounting base adapted for attachment to a backhoe bucket, which base includes:

a generally rectangular base plate;

a pair of spaced attaching plates secured to one side of said base plate and projecting outwardly therefrom, each of said side plates having a concave free edge adapted to mate with the convex arcuate rear side of a backhoe bucket;

a pair of spaced, parallel, apertured tooth-mounting ears secured to the opposite side of said base plate from said attaching plates and having a pair of aligned pin-receiving apertures therethrough;

an impact pad secured to said base plate on the same side thereof as said tooth-mounting ears between said mounting ears and spaced along said base plate from said pin-receiving apertures;

an elongated ripper tooth including a point at one end, an impact surface at the other end and a shank portion therebetween, said shank portion having a pin opening therethrough aligned with said pin-receiving apertures when said shank portion is located between said tooth-mounting ears with said impact surface contacting said impact pad;

a pivot pin extending through said pin opening and through said aligned pin-receiving apertures to pivotally mount said ripper tooth between said tooth-mounting ears for pivoting movement to swing said impact surface into and out of contact with said impact pad; and means for detachably retaining said pivot pin extended through said pin-receiving apertures and said pin opening to pivotally mount said ripper tooth.

2. A ripper tooth attachment assembly for a backhoe as defined in claim 1 wherein said means for detachably retaining said pivot pin extended through said pin apertures and pin openings comprises:

a split washer ring removably carried on said pivot pin adjacent one of its ends; and a head secured on said pivot pin adjacent its opposite end.

3. A ripper tooth attachment assembly for a backhoe as defined in claim 1 wherein said impact pad extends from one of said ears to the other of said ears.

4. A ripper tooth attachment assembly for a backhoe as defined in claim 3 wherein said means for detachably retaining said pivot pin extended through said pin apertures and pin openings comprises:

a split washer ring removably carried on said pivot pin adjacent one of its ends; and a head secured to said pivot pin adjacent its opposite end.

5. A backhoe excavating and ripper apparatus for loosening and removing earth comprising:

a backhoe bucket having an open front side and having an arcuate back wall forming a bottom of the bucket, said back wall having a convex outer surface thereon;

bucket teeth on the lower forward side of said bucket back wall;

a pair of ripper tooth retention lugs projecting outwardly from the back wall of the bucket on the convex outer surface thereof; and a ripper tooth attachment assembly secured to the convex outer surface of said back wall for selectively enhancing the earth removing capacity of said bucket, said ripper tooth attachment assembly comprising:

a mounting base subassembly including:

a base plate;

a plurality of spaced attaching plates each secured to one side of said base plate and having a concave contact edge contacting, mating with and secured to said convex outer surface of the back wall of said backhoe bucket at a location spaced from said retention lugs;

a pair of spaced, parallel apertured tooth-mounting lobes secured to and projecting from the opposite side of said base plate from said attaching plates, each of said lobes defining a pivot pin-receiving aperture extending therethrough with all said pivot pin-receiving apertures aligned for concurrent receipt of a common pivot pin;

an impact pad secured to said base plate on said opposite side thereof at a location between said tooth-mounting lobes and spaced from said aligned pivot pin receiving apertures;

an elongated ripper tooth including a point at one end, an impact surface at the other end and a shank portion therebetween, said shank portion having a pin opening therethrough aligned with said pin-receiving apertures when said shank portion is located between said tooth-mounting ears with said impact surface contacting said impact pad;

a pivot pin extending through said pin opening and through said aligned pin-receiving apertures to pivotally mount said ripper tooth between said tooth-mounting ears for pivoting movement to swing said impact surface into and out of contact with said impact pad; and means for detachably retaining said pivot pin extended through said pin-receiving apertures and said pin opening to pivotally mount said ripper tooth.

* * * * *